US006582142B2

(12) United States Patent
Keller et al.

(10) Patent No.: US 6,582,142 B2
(45) Date of Patent: Jun. 24, 2003

(54) PERMANENT INK MARKER FOR RE-IDENTIFYING WIRE

(76) Inventors: Robert Earl Keller, 3273 Sears Rd., Spring Valley, OH (US) 45370; Paul David Vicars, 1968 Armstrong Rd., Fairborn, OH (US) 45324

( * ) Notice: Subject to any disclaimer, the term of this patent is extended or adjusted under 35 U.S.C. 154(b) by 0 days.

(21) Appl. No.: 10/058,542

(22) Filed: Jan. 28, 2002

(65) Prior Publication Data

US 2002/0100138 A1 Aug. 1, 2002

Related U.S. Application Data

(60) Provisional application No. 60/264,449, filed on Jan. 26, 2001.

(51) Int. Cl.[7] ..... A46B 11/00
(52) U.S. Cl. ..... 401/11; 401/9; 401/198
(58) Field of Search ..... 401/9, 10, 11, 401/198, 199

(56) References Cited

U.S. PATENT DOCUMENTS

| | | | | | |
|---|---|---|---|---|---|
| 1,166,896 | A | * | 1/1916 | Garvey | 401/98 |
| 3,056,998 | A | * | 10/1962 | Ebner | 401/10 |
| 3,352,623 | A | * | 11/1967 | Sanet | 401/10 |
| 5,820,285 | A | * | 10/1998 | Ikeda et al. | 401/199 |
| 6,280,109 | B1 | * | 8/2001 | Serratore | 401/11 |

* cited by examiner

*Primary Examiner*—David J. Walczak
(74) *Attorney, Agent, or Firm*—R W Becker & Associates; R W Becker

(57) ABSTRACT

A permanent ink marker for re-identifying insulated wire. The marker has a container for ink, and a nib that is disposed on the container and in communication with the interior thereof. The nib is provided with a slit that extends from an end of the nib that is remote from the container in a direction toward the container. The end of the slit remote from the end of the nib is preferably widened, and can have a circular cross-section. The end of the nib preferably has a notch where the slit starts.

18 Claims, 1 Drawing Sheet

PERMANENT INK MARKER FOR RE-IDENTIFYING WIRE

This application is a provisional application Ser. No. 60,264,449 filed on Jan. 26, 2001.

BACKGROUND OF THE INVENTION

The present invention relates to a permanent ink marker for re-identifying wire, especially electrical wire.

Recently, the National Electrical Code, Article 200-7(c)(2), was changed to require the permanent re-identification of any "white, natural gray insulation or a marking of three continuous white stripes" when used as follows:

200-7 (c) (2) "Where a cable contains an insulated conductor for single pole, 3-way, or 4-way switch loops, and the conductor with white or natural gray insulation or a marking of three continuous white stripes is used for the supply to the switch, but not the return conductor from the switch to the switched outlet. In these applications, the conductor with white or natural gray insulation or with three continuous white stripes shall be permanently re-identified to indicate its use by painting or other effective means at its terminations and at each location where the conductor is visible and accessible."

When a "white, natural gray or a marking of three continuous stripes" cable (or wire) addressed in Article 200-7(*c*)(2) above (hereinafter referred to as a "grounded wire" for clarity of discussion) is required to carry current, this new change to the code requires the grounded insulated wire be "re-identified" so everyone will know that this wire is being used as a current-carrying ungrounded insulated wire. This change in the code was established as a safety precaution to preclude anyone from mistaking the use of the grounded insulated wire when used as an ungrounded insulated wire. Such a mistake could result in a severe shock or even death.

While the code was well meaning, it did not describe in detail how to "re-identify" such wires. Article 200-7(c)(2) of the code states that such re-identification should be by "painting or other effective means". To "paint" the wires requires care to make sure that no other wire is painted or re-identified by overspray or an inadvertent swipe of a brush against the wrong wires. Furthermore, painting is messy, inconvenient and is not the common practice used today. The common method for re-identifying these wires is to place several pieces of electrical tape around the grounded wire's insulation so as to "re-identify" it as an ungrounded, insulted wire. This method is dependent upon the interpretation of the authority having jurisdiction and does not really convey to everyone that this grounded wire is now being used as an ungrounded insulated wire. Furthermore, with hundreds of wires needing to be re-identified in a typical wiring installation, taping all of these grounded wires with several pieces of electrical tape can be quite time consuming and tedious, and is not necessarily permanent.

It is therefore an object of the present invention to provide a quick, easy and permanent way to re-identify wires, especially grounded insulated wires.

BRIEF DESCRIPTION OF THE DRAWING

This object, and other objects and advantages of the present invention, will appear more clearly from the following specification in conjunction with the accompanying schematic drawing, in which.

SUMMARY OF THE INVENTION

Figure 1:
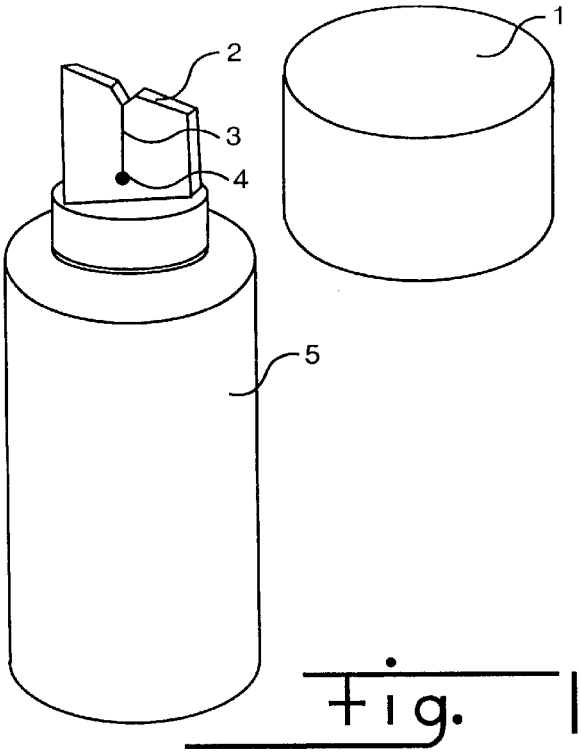
FIG. 1 shows one exemplary embodiment of the inventive permanent ink marker with its unique nib.

The marker of the present invention is characterized primarily by a container for ink, and a nib that is disposed on the container and is in communication with the interior of the container; the nib is provided with a slit that extends from an end of the nib that is remote from the container in a direction toward the container. The bottom end of the slit, remote from the end of the nib, is widened, and preferably has a circular cross-section.

The present invention provides a quick, easy-to use permanent and hence more reliable means for re-identifying insulated wires, especially electrical or grounded wires. When a wire is to be re-identified, the cap of the permanent ink marker is removed and the wire that is to be re-identified is pushed down along the slot through the middle of the nib of the marker until the wire is lodged in the hole near the base of the nib. The marker is then moved along the insulation of the wire that is to be re-identified (re-colored) thereby encircling such insulation, and is then pulled off the wire, or the wire is pulled out of the hole. This leaves the wire permanently re-identified by completely re-coloring the portion of the wire insulation that is to be re-identified. This quick, easy operation "paints" the wire with permanent ink and satisfies the requirement of the National Electrical Code, Article 200-7(c)(2), in a single, easy and permanent operation that leaves everyone without confusion as to the re-identified wires purpose for use. The inventive marker is also a safe way to re-identify such wires, satisfying all safety issues addressed in such Article 200-7(c)(2).

The applicants explored numerous alternative methods for satisfying the aforementioned electrical code. Variations of the shape of the nib were considered but were discounted since their shape could cause the permanent ink to leak from the nib, thus creating a mess for the user, although a conventional permanent ink marker could be used without the inventive modification, it would require the insulation of the wire to be re-identified (re-colored) by hand on all sides, doing one side at a time, which would of course take considerably more time. Modifying the conventional markers nib by placing only a large cut in the top of the nib, or by placing a hole near the top of the nib, was considered to be inferior to the inventive placement of the hole near the base of the nib for three reasons. First of all, placing the hole near the base of the nib minimizes the stress to the nib when the permanent ink marker is pulled along the length of the wire that is being re-identified (re-colored). In addition, placement of the hole near the base of the nib ensures the maximum flow of ink from the ink canister or container of the marker. Finally, placement of the hole near the base rather than at the top, of the nib, prevents the nib from spreading apart and the marker is used on larger wires, which would cause the larger wires to be not completely re-identified (re-colored).

Further specific features of the present invention will be described in detail subsequently.

DESCRIPTION OF PREFERRED EMBODIMENTS

Referring now to the drawing in detail, FIG. 1 shows the permanent ink container 5 and a cap 1 of a conventional marker. However, the element or nib 2 of the marker has been inventively modified and is provided with a vertical slit 3 that starts at the top of the nib, at the small V-shaped notch, and ends in a hole 4 near the base of the nib. The V-shaped notch allows for a quick and easy location of a wire in the slit 3. In addition, if the wire is larger than the hole 4, the notch itself can be used to re-identify a wire or conductor, although it would then be necessary to recolor the other side of the wire as well. It should be noted that although it is preferable to have the V-shaped notch, the notch is not mandatory. The hole 4 is wider than the slit 3, and has a diameter that, for example, will accommodate insulated AWG (American Wire Gauge) number 8 through number 14. The hole could of course be smaller or larger, for example to accommodate a number 6 or larger wire. In addition, although being described as a circular hole, the cross-sectional configuration of such "hole" or widened portion could also have any other desired shape, although circular is normally best suited for wires.

Figure 2:
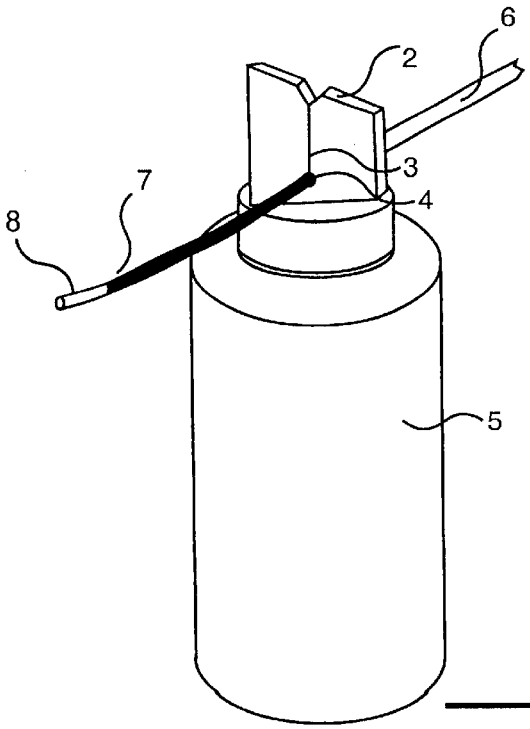
FIG. 2 shows how the white insulation of an electrical wire is re-identified (re-colored)) by passing the wire through the unique nib of the marker.

FIG. 2 shows a grounded insulated electrical wire 6 that has been pushed down on the top of the nib 2 at the small V-shaped notch at the top of the slit 3, and has then traveled down the vertical slit 3 until the insulated wire 6 has become lodged in the hole 4. Once the insulated wire 6 is in the hole 4, the wire is pushed or pulled through the hole 4, whereby the marker encircles the entire length of exposed insulation, causing the insulation of the wire to be re-identified (re-colored) as indicated by the black wire insulation color 7. This black color then re-identifies the formerly grounded insulated wire as an ungrounded black insulated wire. Although the wire color 7 has been depicted as black in FIG. 2, it is to be understood that a wide variety of colors could be used to re-identify (re-color) the insulated wire 6, depending upon the use of the wire. Once the wire has been re-identified or re-colored the marker is pulled off of the wire by reversing the aforementioned process or by exiting off of the wire end 8. After the process has been completed, the cap 1 should be replaced on the marker to prevent the ink in the nib 2 from drying out while the marker is not in use.

Although the ink container 5 has been illustrated as being cylindrical, it is to be understood that it could have any other desired shape, such as flat or multi-sided. The container 5 and/or the cap 1 could also be color-coded to indicate the color of the ink that is contained in the container 5.

Similarly, although the nib 2 has been illustrated as being flat, i.e., as having a relatively thin sheet-like configuration, with a thickness of, for example, ⅜ of an inch, the nib could of course be thicker, and could have a square or even round cross-section.

As can be seen from the drawing, the slit 3 preferably extends down the center of the nib 2 from the V-shaped notch to the hole 4. Since the nib is typically made of very flexible material, such as felt or similar ink-absorbing material, the slit does not have to result in a space between the portions or opposite sides of the slit. This creates a tight fit that helps prevent the wire 6 from inadvertently or prematurely slipping out of the hole 4.

The present invention is, of course, in no way restricted to the specific disclosure of the specification and drawings, but also encompasses any modifications within the scope of the appended claims.

We claim:

1. A permanent ink marker for re-identifying insulated wire, comprising:

a container for ink; and a nib disposed on said container and in communication with an interior of said container, wherein said nib is provided with a slit that extends from an end of said nib that is remote from said container in a direction toward said container, wherein said slit ends prior to said container, wherein an end of said slit that is remote from said end of said nib is widened relative to a remainder of said slit, and wherein said nib has a sheet-like configuration.

2. A permanent ink marker for re-identifying insulated wire, comprising:

a container for ink; and a nib disposed on said container and in communication with an interior of said container, wherein said nib is provided with a slit that extends from an end of said nib that is remote from said container in a direction toward said container, wherein said slit ends prior to said container, wherein an end of said slit that is remote from said end of said nib is widened relative to a remainder of said slit, and wherein said widened end of said slit has a circular cross-section.

3. A permanent ink marker according to claim 2, wherein said end of said nib has a notch at the location of said slit.

4. A permanent ink marker according to claim 3, wherein said notch is V-shaped.

5. A permanent ink marker according to claim 2, wherein said container has a cylindrical shape, and is provided with a cap that fits over said nib.

6. A permanent ink marker according to claim 2, wherein said nib has a sheet-like configuration.

7. A permanent ink marker according to claim 2, wherein said circular cross-section has a diameter that will accommodate insulated AWG number 8 to number 14 wire.

8. A permanent ink marker for re-identifying insulated wire, comprising:

a container for ink; and a nib disposed on said container and in communication with an interior of said container, wherein said nib is provided with a slit that extends from an end of said nib that is remote from said container in a direction toward said container, wherein said slit ends prior to said container, wherein an end of said slit that is remote from said end of said nib is widened relative to a remainder of said slit, and wherein said end of said nib has a notch at the location of said slit.

9. A permanent ink marker according to claim 8, wherein said nib has a sheet-like configuration.

10. A permanent ink marker according to claim 8, wherein said widened end of said slit has a circular cross-section.

11. A permanent ink marker according to claim 10, wherein said circular cross-section has a diameter that will accommodate insulated AWG number 8 to number 14 wire.

12. A permanent ink marker according to claim 8, wherein said container has a cylindrical shape, and is provided with a cap that fits over said nib.

13. A permanent ink marker according to claim 8, wherein said notch is V-shaped.

14. A permanent ink marker according to claim 1, wherein said container has a cylindrical shape, and is provided with a cap that fits over said nib.

15. A permanent ink marker according to claim 1, wherein said widened end of said slit has a circular cross-section.

16. A permanent ink marker according to claim 15, wherein said circular cross-section has a diameter that will accommodate insulated AWG number 8 to number 14 wire.

17. A permanent ink marker according to claim 1, wherein said end of said nib has a notch at the location of said slit.

18. A permanent ink marker according to claim 17, wherein said notch is V-shaped.

* * * * *